US006073613A

United States Patent [19]

Warner

[11] Patent Number: 6,073,613

[45] Date of Patent: Jun. 13, 2000

[54] FUEL REGULATOR ADJUSTMENT SYSTEM AND METHOD OF USING SAME

[76] Inventor: Derrick Warner, R.R. 2, Box 119F, Grand Forks, N. Dak. 58203

[21] Appl. No.: 09/041,555

[22] Filed: Mar. 12, 1998

[51] Int. Cl.[7] ..... F02M 41/00

[52] U.S. Cl. ..... 123/463; 137/529

[58] Field of Search ..... 123/463, 456, 123/447, 467, 510, 529

[56] References Cited

U.S. PATENT DOCUMENTS

| | | | |
|---|---|---|---|
| 2,260,688 | 10/1941 | L'Orange | 123/463 |
| 2,741,262 | 4/1956 | Crookston | 137/529 |
| 4,327,767 | 5/1982 | Fehrenbach | 137/510 |
| 4,543,935 | 10/1985 | Tuckey | 137/510 |
| 4,920,942 | 5/1990 | Fujimori | 123/497 |
| 5,056,555 | 10/1991 | Frijlink | 137/529 |
| 5,381,816 | 1/1995 | Alsobrooks | 137/510 |
| 5,619,972 | 4/1997 | Kuenzli | 123/497 |

*Primary Examiner*—Carl S. Miller

[57] ABSTRACT

A fuel regulator adjustment system for allowing a user of a snowmobile to specifically adjust the fuel pressure within the fuel system to a desired constant pressure. The inventive device preferably includes a pressure gauge within the fuel system, a tube removably attachable to a vacuum/boost compensation port of a conventional fuel regulator, a valve positioned within the tube, and a vacuum/boost device connected to the tube which selectively creates a vacuum or pressure within the fuel regulator. The user manipulates the vacuum/pressure device to create a vacuum in the fuel regulator if he desires to lower the fuel pressure. If the user desires to increase the fuel pressure, then the vacuum/boost device is manipulated to create pressure within the fuel regulator. After monitoring the pressure gauge to determine that the desired fuel pressure has been reached, the user then closes the valve to maintain the required vacuum or pressure within the fuel regulator.

8 Claims, 5 Drawing Sheets

FUEL REGULATOR ADJUSTMENT SYSTEM AND METHOD OF USING SAME

BACKGROUND OF THE INVENTION

1. Field of the Invention

The present invention relates generally to fuel regulators for snowmobiles and more specifically it relates to a fuel regulator adjustment system for allowing a user of a snowmobile to specifically adjust the fuel pressure within the fuel system to a desired constant pressure.

When a snowmobile is first manufactured and the fuel system is installed, usually the fuel regulator is preset between 38–40 psi. However, the manufacturer suggests utilizing a lower fuel pressure which is normally 36.2 psi. Because the fuel regulators are preset to have more pressure than is recommended by the manufacturer, a richer mixture is utilized which is sometimes undesirable for a snowmobile rider. In order to maximize performance of a snowmobile engine, often the fuel pressure is desirably lower for a leaner mixture to increase horsepower. Hence, there is a need to allow snowmobile users to manually adjust the fuel pressure within the fuel system of their snowmobiles using a simple and inexpensive method.

2. Description of the Prior Art

There are numerous fuel injection control systems. For example, U.S. Pat. No. 4,282,710 to Avant; U.S. Pat. No. 5,379,740 to Moore et al; and U.S. Pat. No. 5,463,997 to Cutler are all illustrative of such prior art. Also, AAEN sells an after-market replacement fuel regulator which utilizes a threaded fastener within an upper portion of the fuel regulator to adjust the pressure of the compression spring.

Avant (4,282,710) discloses a system and method for selectively and controllably supplying a pre-selected pressure source for controlling a pressure-responsive fuel flow metering system for use as a Mach number hold unit for controlling fuel flow to aircraft jet engines. Avant teaches a pressure calculation means, a valve means and a switch means connected to the valve means.

While these devices may be suitable for the particular purpose to which they address, they are not as suitable for allowing a user of a snowmobile to specifically adjust the fuel pressure within the fuel system to a desired pressure. The prior art is either constructed of a complex structure which is uneconomical to produce or it does not provide a means for maintaining a constant fuel pressure with the fuel system of a snowmobile.

In these respects, the fuel regulator adjustment system according to the present invention substantially departs from the conventional concepts and designs of the prior art, and in so doing provides an apparatus primarily developed for the purpose of allowing a user of a snowmobile to specifically adjust the fuel pressure within the fuel system to a desired constant pressure.

SUMMARY OF THE INVENTION

A primary object of the present invention is to provide a fuel regulator adjustment system that will overcome the shortcomings of the prior art devices.

Another object is to provide a fuel regulator adjustment system that provides a simple means for adjusting the fuel pressure within the fuel system of a snowmobile.

An additional object is to provide a fuel regulator adjustment system that maintains a constant desired fuel pressure within the fuel system.

A further object is to provide a fuel regulator adjustment system that is of a simple construction and use.

Another object is to provide a fuel regulator adjustment system that can be manufactured inexpensively.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
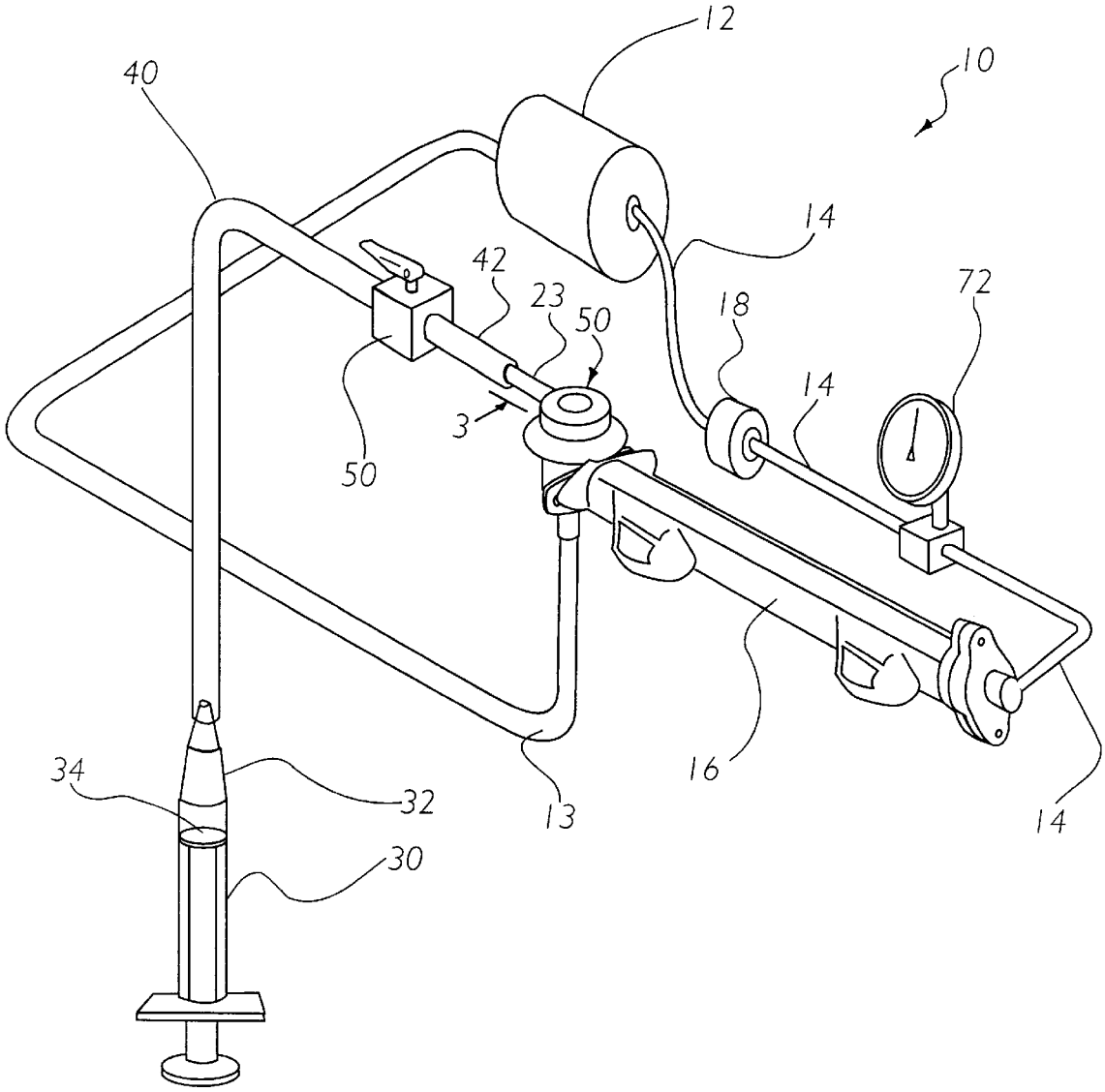
FIG. 1 is an upper perspective view of the present invention.

Turning now descriptively to the drawings, in which similar reference characters denote similar elements throughout the several view, FIGS. 1 through 5 illustrate a fuel regulator adjustment system 10, which comprises a pressure gauge 72 within the conventional fuel system, a tube 42 removably attachable to a vacuum/boost compensation port 23 of a conventional fuel regulator 20, a valve 50 positioned within the tube, and a vacuum/boost device 30 connected to the tube 42 which selectively creates a vacuum or pressure within the fuel regulator 20.

Figure 2:
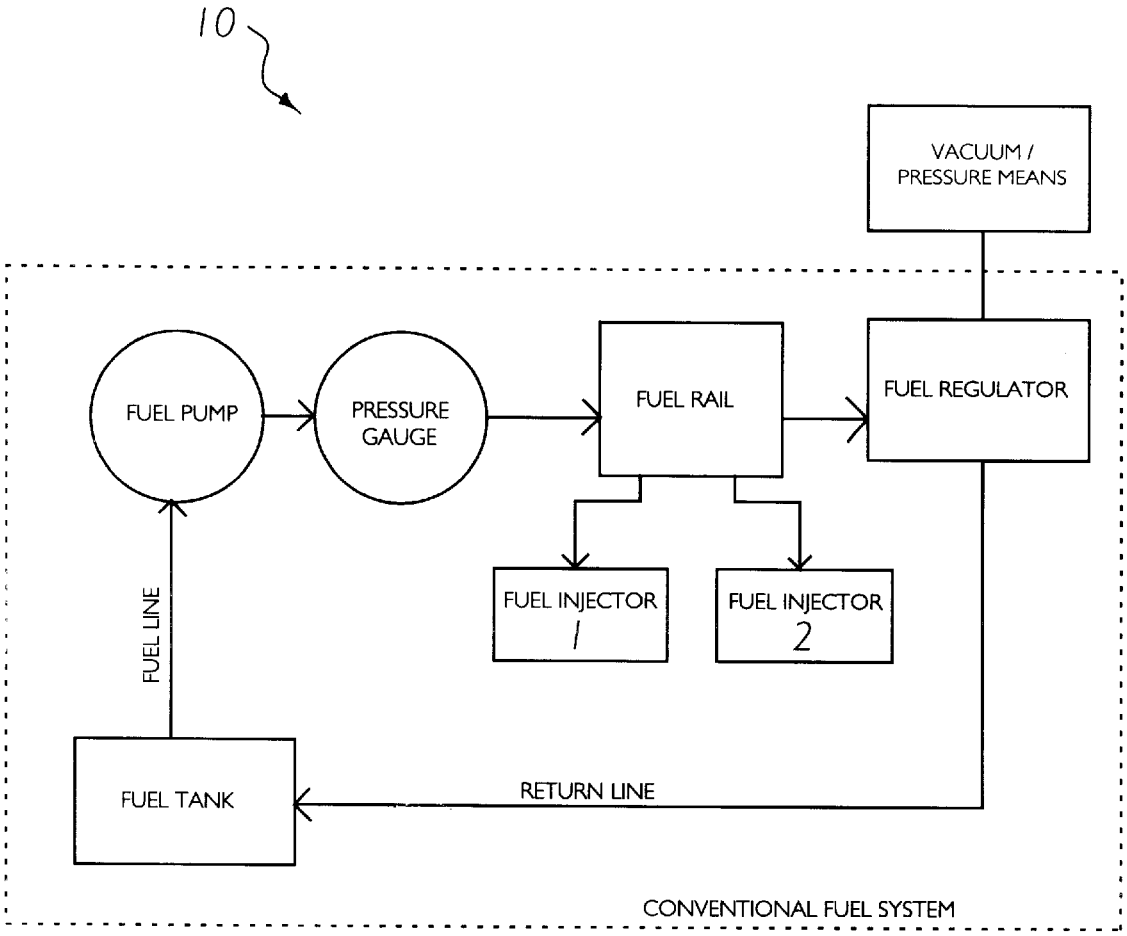
FIG. 2 is a box diagram of the present invention.

In a conventional fuel system for snowmobiles, as shown in FIGS. 1 and 2 of the drawings, a fuel pump 18 is connected to a fuel tank 12. The fuel pump 18 draws fuel from the fuel tank 12 which is forced into a fuel rail 16 which is connected to at least one fuel injector. A fuel regulator 20 is connected to the fuel rail 16 opposite of the fuel pump 18 which regulates the fuel pressure within the fuel rail 16. The fuel regulator 20 is usually factory set to maintain a constant 38–40 psi within the fuel rail 16. However, most manufacturers recommend having approximately 36.2 psi within the fuel rail 16 for optimal performance.

Figure 3:
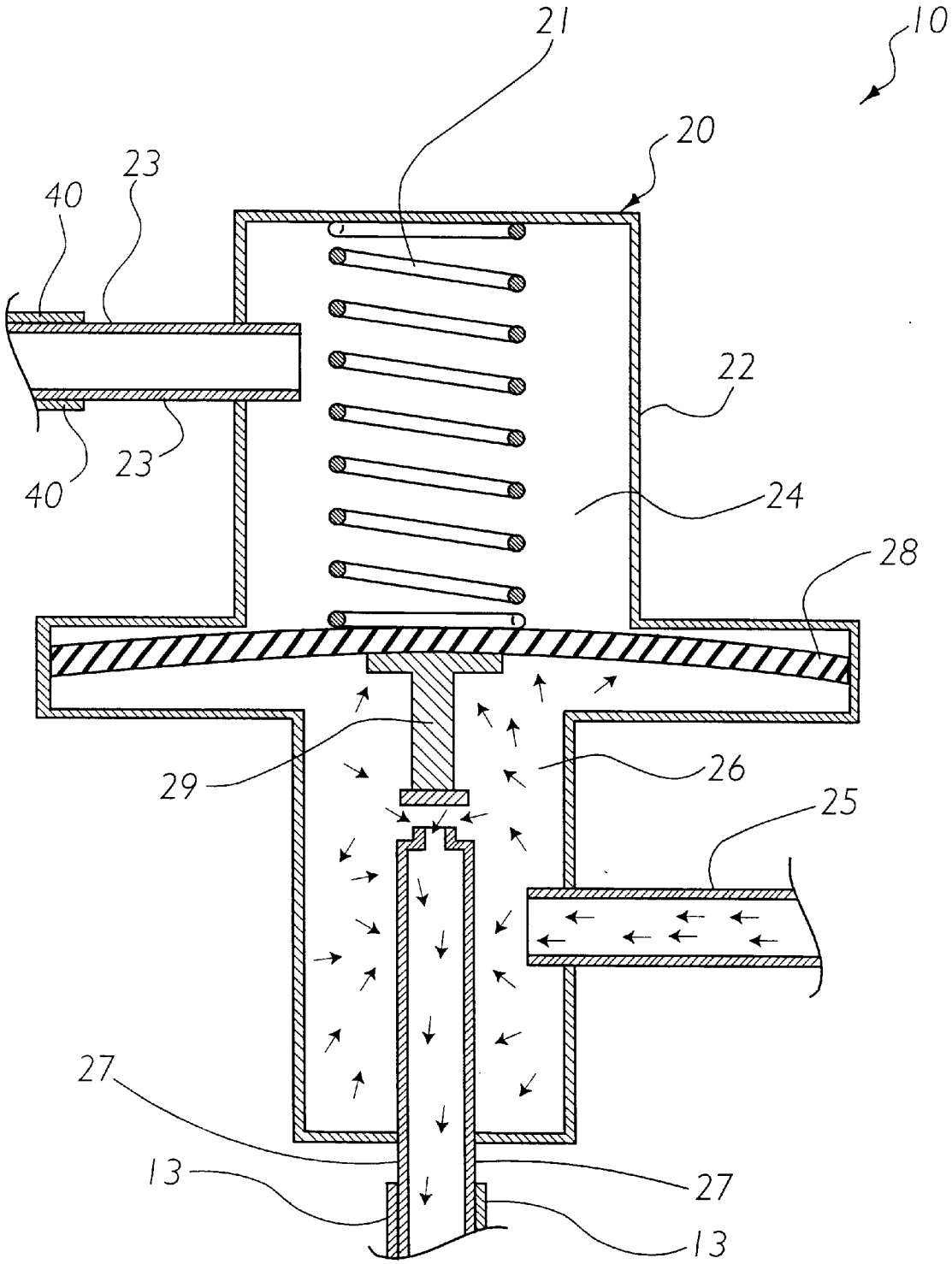
FIG. 3 is a cross sectional view taken along line 3—3 of FIG. 1 disclosing the interior portion of a conventional fuel regulator.

As shown in FIG. 3 of the drawings, the conventional fuel regulator 20 has a housing 22 comprising an upper chamber 24 and a lower chamber 26 separated by a resilient diaphragm 28. A vacuum/boost compensation port 23 projects into the upper chamber 24 as shown in FIG. 3. A compression spring 21 is within the upper chamber 24 which is positioned between the diaphragm 28 and a ceiling of the upper chamber 24.

As further shown in FIG. 3 of the drawings, the conventional fuel regulator 20 also has an outlet tube 27 positioned within the floor of the lower chamber 26 which has a nipple end. An inlet manifold 25 is positioned within the lower chamber 26 of the fuel regulator 20 which receives fuel from the fuel rail 16. A flanged end shaft 29 is centrally attached to the diaphragm 28 opposite of the compression spring 21 as shown in FIG. 3. The flanged portion of the flanged end shaft 29 is normally in full engagement with the nipple end of the outlet tube 27 when there is no fuel pressure within the fuel rail 16.

As shown in FIG. 3 of the drawings, when fuel pressure is within the fuel rail 16, then the fuel pressure enters the lower chamber 26 thereby forcing the diaphragm 28 upwardly overcoming the force of the compression spring 21. As the diaphragm 28 is forced upwardly, the flanged portion of the flanged end shaft 29 is removed from nipple end of the outlet tube 27 thereby allowing fuel from fuel rail 16 to exit through the outlet tube 27. The amount of fuel allowed to exit through the outlet tube 27 is directly proportional to the distance between the flanged end shaft 29 and the outlet tube 27. The distance between the flanged end shaft 29 and the outlet tube 27 is directly proportional to the amount of pressure within the lower chamber 26. Hence, initially the fuel pressure within the fuel system will be high until the fuel regulator 20 releases the excess fuel pressure. After a finite period of time, the fuel pressure within the fuel system will level off to a constant fuel pressure.

Figure 4:
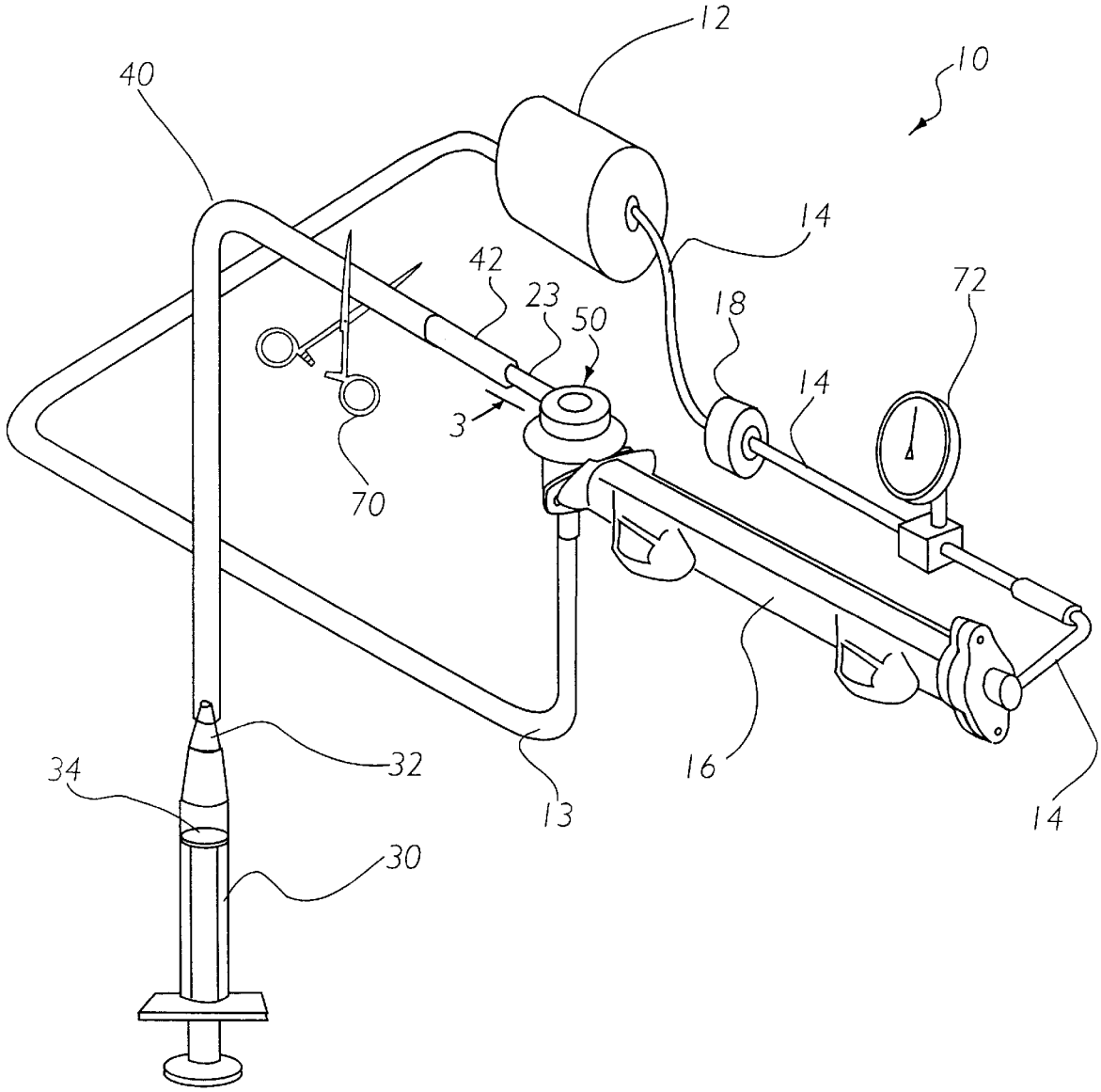
FIG. 4 is an upper perspective view of a second embodiment of the present invention.
Figure 5:
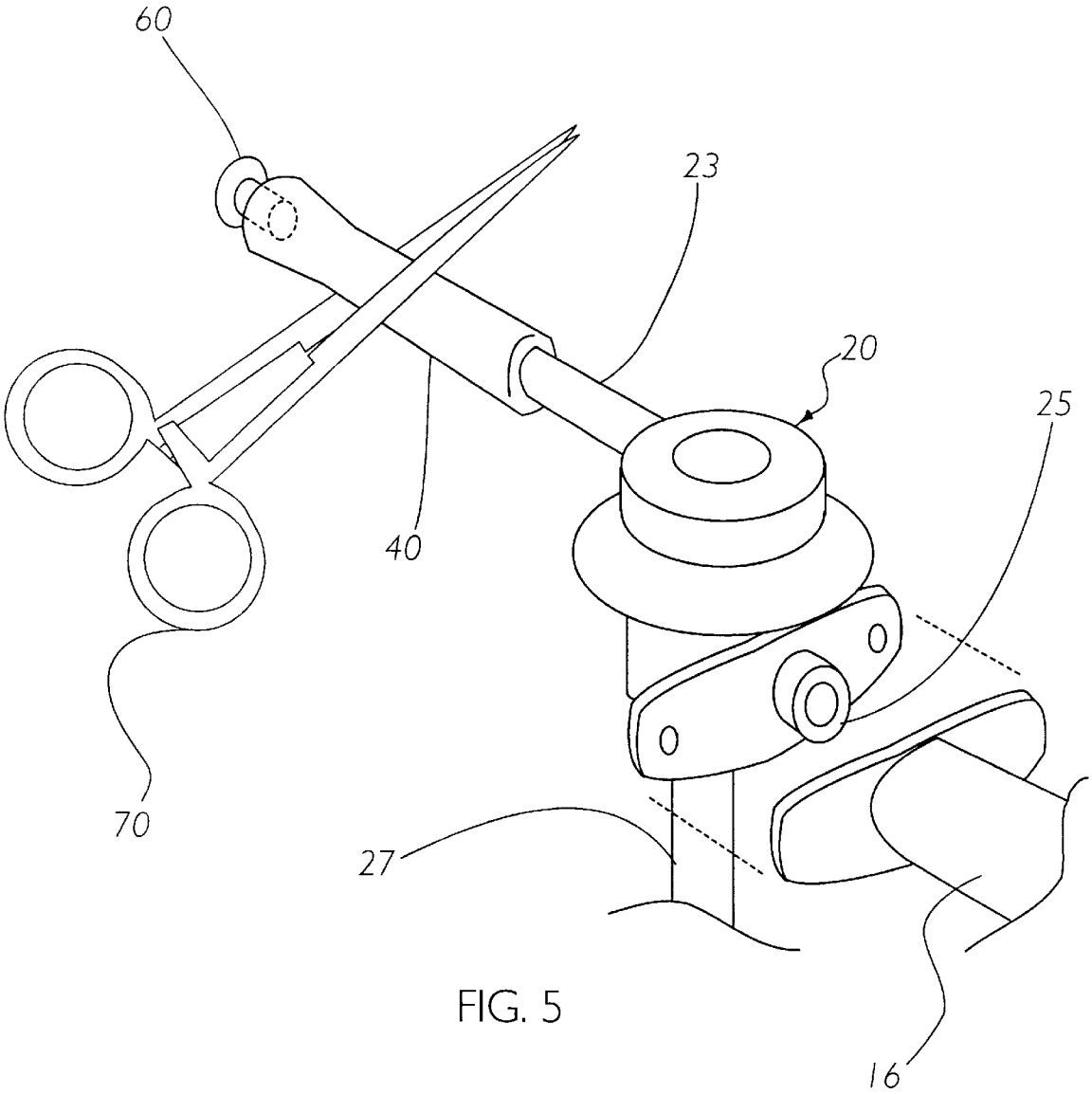
FIG. 5 is an upper perspective view of the locking pliers in engagement with the connecting tube.

As shown in FIGS. 1, 2 and 4 of the drawings, the outlet tube 27 is connected to the fuel tank 12 by a return line 13 allowing the excess fuel from the fuel regulator 20 to return back to the fuel tank 12. The fuel pump 18 is fluidly connected to the fuel tank 12 by a length of hose 14 as shown in FIGS. 1 and 4. The fuel pump 18 is fluidly connected to the fuel rail 16 by another length of hose 14 as shown in FIGS. 1 and 4 of the drawings.

In the preferred embodiment of the present invention as shown in FIG. 1 of the drawings, a second connecting tube 42 is connected to the vacuum/boost compensation port 23 of the fuel regulator 20 as shown in FIGS. 1 and 4 of the drawings. A valve 50 is connected to the end of the second connecting tube 42 opposite of the vacuum/boost compensation port 23. A first connecting tube 40 is connected to the valve 50 opposite of the second connecting tube 42 as best shown in FIG. 1 of the drawings. A tapered end 32 of a syringe 30 having a plunger 34 is connected to the end of the first connecting tube 40 opposite of the valve 50 as shown in FIG. 1. Any device may be utilized in place of the syringe 30 which may create pressure or create a vacuum. As shown in FIGS. 1 and 2 of the drawings, a pressure gauge 72 is fluidly connected between the fuel pump 18 and the fuel rail 16 within the length of hose 14. The pressure gauge 72 discloses the fuel pressure within the conventional fuel system.

In use of the preferred embodiment, the user turns on the motor connected to the fuel system which creates fuel pressure within the conventional fuel system. The user views the disclosed fuel pressure on the pressure gauge 72. If the fuel pressure is higher than desirable, for example 40 psi, the user would manipulate the syringe 30 to create a vacuum within the upper chamber 24 of the fuel regulator 20. This vacuum within the upper chamber 24 will pull upon the diaphragm 28 thereby allowing the distance between the flanged end shaft 29 and the outlet tube 27 to expand, thereby reducing the fuel pressure within the fuel system. If the fuel pressure is to low, for example 34 psi, then the user would manipulate the syringe 30 to create a higher pressure within the upper chamber 24 thereby forcing the flanged end shaft 29 towards the outlet tube 27 which creates a higher pressure within the fuel system. After the fuel system has been manipulated to the desired fuel pressure, such as 36.2 psi, the user then closes the valve 50 which maintains a constant desired pressure/vacuum within the upper chamber 24. The user then removes the syringe 30 and the first connecting tube 40 so as to not interfere with the normal operation of the snowmobile, or other vehicle utilized.

In an alternative embodiment as shown in FIG. 4 of the drawings, the valve 50 is removed and only the first connecting tube 40 is connected to the vacuum/boost compensation port 23 of the fuel regulator 20. The user manipulates the syringe 30, or other device, as in the preferred embodiment to achieve the desired fuel pressure within the fuel system. After the desired fuel pressure is achieved within the fuel system, the user positions a locking pliers 70 about the first connecting tube 40 near the vacuum/boost compensation port 23 as shown in FIG. 4 of the drawings. The user then clamps the locking pliers 70 about the first connecting tube 40 so as to seal the upper chamber 24 of the fuel regulator 20. The user thereafter severs the first connecting tube 40 behind the locking pliers 70 with a conventional knife and inserts a plug 60 into the severed end of the first connecting tube 40. The user then releases the locking pliers 70 from the first connecting tube 40, thereby allowing the plug 60 to maintain a constant pressure/vacuum within the remaining first connecting tube 40 and upper chamber 24.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of adjusting fuel pressure within a conventional fuel system, said method comprising the steps of:

(a) connecting a second end of a tube to a vacuum/boost compensation port of a conventional fuel regulator;

(b) connecting a vacuum/pressure means to a first end of said tube;

(c) monitoring a fuel pressure of said conventional fuel system;

(d) generating a vacuum within an upper chamber of a fuel regulator if said fuel pressure is higher than desirable;

(e) generating pressure within said upper chamber if said fuel pressure is lower than desirable;

(f) monitoring said fuel pressure;

(g) repeating steps (c) through (f) until a desirable fuel pressure is maintained within said conventional fuel system;

(h) securing a locking pliers to said tube between said first end and said second thereby creating a seal;

(i) removing said vacuum/pressure means from said first end of said tube;

(j) inserting a plug into said first end; and (k) removing said locking pliers from said tube.

2. The method of adjusting fuel pressure within a conventional fuel system of claim 1, said method after step (i) further comprising the step of cutting said tube adjacent said locking pliers to shorten said first end of said tube.

3. A method of adjusting fuel pressure within a conventional fuel system, said method comprising the steps of:

(a) generating a vacuum within an upper chamber of a fuel regulator if said fuel pressure is higher than desirable;

(b) generating pressure within said upper chamber if said fuel pressure is lower than desirable;

(c) monitoring said fuel pressure;

(d) repeating steps (a) through (c) until a desirable fuel pressure is maintained within said conventional fuel system; and (e) maintaining a constant pressure or vacuum within said upper chamber.

4. A fuel regulator adjustment system for allowing adjustment of fuel pressure within a conventional fuel system comprising:

a length of tube having a first end and a second end, said second end connectable to a vacuum/boost compensation port of a fuel regulator, wherein said fuel regulator has a pressure diaphragm within;

a vacuum/pressure means removably connectable to said first end of said length of tube for selectively creating a vacuum or pressure within said length of tube and said fuel regulator; and a valve means selectively engageable within said length of tube for maintaining a constant pressure or vacuum within said length of tube and said fuel regulator.

5. The fuel regulator adjustment system of claim 4, including a pressure gauge connected within said conventional fuel system for determining said fuel pressure and displaying said fuel pressure.

6. The fuel regulator adjustment system of claim 4, wherein said vacuum/pressure means is comprised of a tubular structure with a plunger positioned within which allows a user to manually manipulate said plunger for creating pressure or vacuum within said length of tube.

7. The fuel regulator adjustment system of claim 4, wherein said valve means comprises:

a locking pliers removably engageable with said length of tube; and a plug for removable insertion into said first end of said length of tube for maintaining a constant pressure or vacuum within said length of tube and said fuel regulator.

8. The fuel regulator adjustment system of claim 5, wherein said pressure gauge is positioned between a fuel pump and a fuel rail of said convention fuel system.

* * * * *